US007503986B2

(12) United States Patent
Kamat et al.

(10) Patent No.: US 7,503,986 B2
(45) **Date of Patent: *Mar. 17, 2009**

(54) METHOD FOR SHORTENING PRODUCTION TIME OF HEAT TREATED ALUMINUM ALLOYS

(75) Inventors: Rajeev G. Kamat, Murrysville, PA (US); William D. Bennon, Kittanning, PA (US); Shawn J. Murtha, Monroeville, PA (US)

(73) Assignee: Alcoa, Inc. PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/347,948

(22) Filed: Jan. 21, 2003

(65) Prior Publication Data

US 2004/0140025 A1 Jul. 22, 2004

(51) Int. Cl.
*C22F 1/05* (2006.01)

(52) U.S. Cl. ..... 148/690; 148/698; 148/700

(58) Field of Classification Search ..... 148/690, 148/694, 701, 700, 698
See application file for complete search history.

(56) References Cited

U.S. PATENT DOCUMENTS

| | | | | |
|---|---|---|---|---|
| 4,030,947 | A | 6/1977 | Kemper | 148/12.9 |
| 4,212,451 | A | 7/1980 | Klotzbücher et al. | 266/50 |
| 4,495,001 | A | 1/1985 | Bennett et al. | 148/11.5 |
| 4,662,955 | A * | 5/1987 | Dries et al. | 148/577 |
| 4,946,517 | A * | 8/1990 | Cho | 148/693 |
| 5,266,130 | A * | 11/1993 | Uchida et al. | 148/552 |
| 5,922,147 | A | 7/1999 | Valtierra-Gallardo et al. | 148/549 |
| 6,042,369 | A | 3/2000 | Bergman et al. | 432/15 |
| 6,224,693 | B1 | 5/2001 | Garza-Ondarza et al. | 148/549 |
| 2001/0009170 | A1 | 7/2001 | Garza-Ondarza et al. | 148/698 |

OTHER PUBLICATIONS

"Aluminum and Aluminum Alloys" ASM International, 1993, pp. 328-329,361-364,462-463.*
"ASM Handbook: vol. 4 Heat Treating", ASM International, 1991, pp. 851-855.*
"ASM Handbook: vol. 4 Heat Treating", ASM International, 1991, pp. 830-831, 844-861.*
O. R. Singleton, Jr., "Quench-Aging Makes Headway With 6061 Aluminum", pp. 94-95, The Iron Age, Dec. 12, 1963.
E. M. Misjurevich and B. A. Prusakov, "Quench-Aging Combined Heat Treatment of Some Aluminum Alloys With Dispersion Hardening" (4 page translation), pp. 83-90, *fuz. Fax. Prevrashch. Mekh. Svoistva Met. Splavov*, (*Moskva*), 3 (1979).

* cited by examiner

*Primary Examiner*—Roy King
*Assistant Examiner*—Janelle Morillo
(74) *Attorney, Agent, or Firm*—Greenberg Traurig, LLP

(57) ABSTRACT

A method for producing a heat treated aluminum alloy product in a shortened period of time, the method comprising: (a) providing a heat treatable aluminum alloy; (b) working the heat treatable aluminum alloy at a solutionizing temperature to form a product; (c) first stage cooling the product to a critical temperature at which precipitation of second phase particles of the heat treatable aluminum alloy is negligible, wherein the first stage cooling comprises a first stage cooling rate from about 15° F. per second to about 100° F. per second; (d) second stage cooling the product to ambient temperature; (e) heating the product to an artificial aging temperature; and (f) artificially aging the product at the artificial aging temperature for a predetermined artificial aging time to form the heat treated aluminum alloy product.

19 Claims, 12 Drawing Sheets

METHOD FOR SHORTENING PRODUCTION TIME OF HEAT TREATED ALUMINUM ALLOYS

FIELD OF THE INVENTION

The present invention relates to the field of thermomechanical processing of aluminum alloys. The invention is particularly useful for shortening the production time of heat treatable aluminum alloys, while maintaining the required mechanical properties of the alloy.

BACKGROUND OF THE INVENTION

Heat treatable aluminum alloys rely on the controlled precipitation of solute alloying elements to achieve desired mechanical properties such as tensile yield strength, ultimate tensile strength and elongation. This is referred to by those skilled in the art as precipitation hardening. It is also recognized by practitioners of the art that hardening phases in the heat treatable alloys include solute clusters or Guinier-Preston (GP) zones, transition precipitates, transition phase particles, and to a lesser degree, equilibrium phase precipitates. [Hatch, John E., ed., *Aluminum Properties and Physical Metallurgy*, ASM, OH (1984)] With the exception of equilibrium phase precipitates, these hardening phases are not present to a significant degree in as-cast aluminum, and in order to strengthen the alloy, several thermal and/or mechanical treatments are typically employed.

The amounts of soluble alloying elements in heat treatable aluminum alloys exceed the room temperature or near room temperature solid solution solubility limits. Therefore, as-cast heat treatable aluminum alloys typically contain secondary phase particles, which are also known in the metal arts as intermetallic precipitates, equilibrium phase precipitates or simply precipitates. The precipitates found in as-cast alloys are typically coarse and incoherent with the lattice of the aluminum crystals or grains. Further, the as-cast precipitates may exist at grain boundaries. These forms of precipitates do not generally impart significant strength to the aluminum alloy, and may be detrimental to properties such as fatigue and fracture resistance.

A thermal processing step used to strengthen the heat treatable alloys, is called "solution heat treatment" ("SHT") or solutionizing treatment. The SHT is conducted at an elevated temperature, or solutionizing temperature, at which the alloying elements have maximum solubility in the aluminum solid solution, while avoiding equilibrium melting. When the solution heat treated alloy is cooled, the solid solution becomes supersaturated; the equilibrium solubility of the alloying element in the aluminum solid solution is exceeded. This provides a thermodynamic driving force for the precipitation of the second phase particles.

Precipitation of solute alloying elements is further controlled by the diffusion rate of the solute. Diffusion is a kinetic phenomenon, and the diffusion rate decreases as the temperature decreases. The effect of slowing diffusion rates due to cooling is to decrease the precipitation rate of second phase particles. Therefore, as the alloy is cooled, precipitation is favored by supersaturation of solute, but opposed by slower solute diffusion rates.

To achieve desired mechanical properties of the heat treatable aluminum alloy, it is desirable to maintain the supersaturation of the alloy as it is cooled to ambient room temperature. It is possible to maintain a supersaturated condition at room temperature by cooling the alloy at a rate that is fast enough to minimize diffusion and thus minimize precipitation of solute atoms. Cooling after SHT is referred to in the art as "quenching." Quenching to room temperature is typically practiced in the trade as: air quenching, where the alloy is cooled in ambient air (either with or without a fan) or water quenching, where the alloy is immersed in water or an aqueous solution or sprayed with water or an aqueous solution.

After quenching, many solution heat-treated alloys will exhibit increases in mechanical properties at room temperature, due to precipitation of hardening phases. This is referred to by practitioners of the art as "natural aging." Natural aging, to a point where the mechanical properties of the alloy are stable and do not change with time, puts the alloy into what is known as a T4 temper. Controlled precipitation hardening of other alloys requires heating for periods at temperatures above room temperature. This practice is known as "artificial aging." Artificial aging for an artificial aging time period, where peak strength is obtained and where the mechanical properties do not change with further artificial aging puts the alloy into what is known as T6 temper, which is also known as peak strength temper. For some aluminum-magnesium-silicon alloys, designated 6xxx series (or 6000 series) aluminum alloys, such as but not limited to 6061 and 6063, it is possible to attain specified T6 properties when there is no separate furnace SHT. When these alloys are cooled from an elevated-temperature, mechanical working, or shaping process, and they can be artificially aged to attain T6 properties, the alloys may be designated as being in a T5 temper, although T6 is also considered an appropriate designation, providing the mechanical properties meet T6 specifications.

In the extrusion of heat treatable alloys from the 6xxx series, such as aluminum alloy 6061, it is a known practice to heat or "homogenize" a billet of cast aluminum to change the as-cast microstructure, thus allowing better extrusion performance. The homogenized billet is cooled and then reheated before extruding the billet through a die to obtain a desired extruded form, extrusion, or product. The extrusion is then quenched to room temperature either in air, in water, or by using a water mist. The quench rate or cooling rate of this practice will depend upon the geometry of the extruded form, but for a 0.25-inch thick extruded shape, the air quench rate is about 5-10° F. per second. The process of extruding and exiting a die at a temperature similar to the solutionizing temperature followed by quenching is known in the art as "press quenching." After quenching, the extrusion may be stretched by 0.5-1% in order to eliminate any thermal stress distortion, which may have occurred during the quenching process. Typically, the extrusion naturally ages for eight hours or longer, during handling within the production facility. After natural aging, the extrusion is heated in a conventional furnace to a typical artificial aging temperature, which is about 350-400° F. for aluminum alloy 6061. The cycle time for artificial aging includes the steps of heating the extrusion to the artificial aging temperature and holding or "soaking" the extrusion at the artificial aging temperature for a predetermined artificial aging time. The cycle times required to reach a peak strength temper, which meets the specifications for 6061-T6, or 6061-T5, is about 6-10 hours. A flowchart that summarizes this current commercial practice is presented in FIG. 3.

From the description of a known extrusion process of heat treatable aluminum alloy 6061 presented above, it is seen that current practice requires long cycle times of heating and cooling the alloy to obtain a product in peak strength temper. Inventory-on-demand type of manufacturing is not amenable to the current process, and an inventory must be warehoused to meet unexpected customer orders. The current practice is also expensive in that it involves significant labor-intensive metal handling between processing steps.

It is clear that a process for manufacturing heat-treated aluminum alloy products in a shorter period of time, which could also be operated in a continuous or semi-continuous fashion, is desirable. Such a process would be beneficial for improving productivity and would provide significant cost savings.

Accordingly, it is a primary object of the current invention to provide a method of manufacture of a heat-treated aluminum alloy product in a shortened period.

It is a further object of the current invention to provide a rapid aging method of manufacturing a heat-treated aluminum alloy product in a peak strength temper, which requires shorter artificial aging time.

It is another object of this invention to provide a semi-continuous or continuous method of manufacturing a peak strength extruded product.

These and other objects and advantages of the present invention will be more fully understood and appreciated with reference to the following description.

SUMMARY OF THE INVENTION

The objects of the current invention are met by: (a) providing a heat treatable aluminum alloy; (b) working the aluminum alloy at a solutionizing temperature to form a product; (c) first stage cooling the product to a critical temperature at which precipitation of second phase particles of the heat treatable aluminum alloy is negligible, using a first stage cooling rate of about 15° F. per second to about 100° F. per second; (d) second stage cooling the product to ambient temperature; (e) heating the product to an artificial aging temperature; and (f) artificially aging the product at the artificial aging temperature to form a heat-treated aluminum alloy product. In a preferred embodiment, the product is artificially aged for about 5 to 120 minutes at a temperature of about 350° to about 400° F. to form a heat-treated aluminum alloy product.

In another preferred embodiment of the invention, the objects of the invention are afforded by: (a) providing a billet of a heat treatable aluminum alloy; (b) homogenizing the billet; (c) cooling the billet; (d) reheating the billet; (e) extruding the billet at a solutionizing temperature to form an extrusion; (f) first stage cooling the extrusion to about 500° F., using a first stage cooling rate of about 15° F. per second to about 100° F. per second; (g) second stage cooling the extrusion to ambient temperature; (h) heating the extrusion to an artificial aging temperature; and (i) artificially aging the extrusion at the artificial aging temperature to form a heat-treated extrusion. In a preferred embodiment, the extrusion is heated for about 5 to 120 minutes at a temperature of about 350° to about 400° F. to form the heat-treated extrusion.

In still another preferred embodiment of the instant invention, the objects of the invention are realized by: (a) providing a billet of a heat treatable aluminum alloy; (b) heating the billet; (c) forging the billet at a solutionizing temperature to form a forged product; (d) first stage cooling the forged product to about 500° F., using a first stage cooling rate of about 15° F. per second to about 100° F. per second; (e) second stage cooling the forged product to ambient temperature; (f) heating the forged product to an artificial aging temperature; and (g) artificially aging the forged product at an artificial aging temperature to form a heat-treated forged product.In a preferred embodiment, the forged product is artificially aged about 5 to 120 minutes at a temperature of about 350° to about 400° F. to form the heat-treated forged product.

In yet another preferred embodiment, the objects of this invention are met by: (a) providing a heat treatable aluminum alloy rolled product; (b) heating the heat treatable aluminum alloy rolled product to a solutionizing temperature; (c) soaking the heat treatable aluminum alloy rolled product at the solutionizing temperature for a predetermined soak time (d) first stage cooling the heat treatable aluminum alloy rolled product to about 500° F., using a first stage cooling rate of about 15° F. per second to about 100° F. per second; (e) second stage cooling the heat treatable aluminum alloy rolled product to ambient temperature; (f) heating the heat treatable aluminum alloy rolled product to an artificial aging temperature; and (g) artificially aging the heat treatable aluminum alloy rolled product at an artificial aging temperature to form a heat-treated aluminum alloy rolled product. In a preferred embodiment, the heat treatable aluminum alloy rolled product is artificially aged for about 5 to 120 minutes at a temperature of about 350° to about 400° F. to form the heat-treated aluminum alloy product.

In still yet another preferred embodiment, the objects of this invention are met by: (a) providing a heat treatable aluminum alloy; (b) working the heat treatable aluminum alloy at a solutionizing temperature to form a product; (c) cooling the product to a predetermined artificial aging temperature, using a cooling rate of about 15° F. per second to about 100° F. per second; and (d) artificially aging the product at an artificial aging temperature for about 5 to 120 minutes to form a heat-treated aluminum alloy product. In a preferred embodiment, the product is artificially aged for about 5 to 120 minutes at a temperature of about 350° to about 400° F. to form the heat-treated aluminum alloy product.

BRIEF DESCRIPTION OF THE DRAWINGS

Further features, objectives and advantages of the present invention will be made clearer by reference to the accompanying drawings in which.

DETAILED DESCRIPTION OF PREFERRED EMBODIMENTS

The inventive method is effective at significantly reducing the amount of time required for artificial aging of heat treatable aluminum alloys in order to achieve peak or maximum mechanical strengths. In the context of this invention, the term "alloy" refers to heat treatable aluminum alloys, as described in the Background Section herein, unless otherwise specified.

Figure 1:
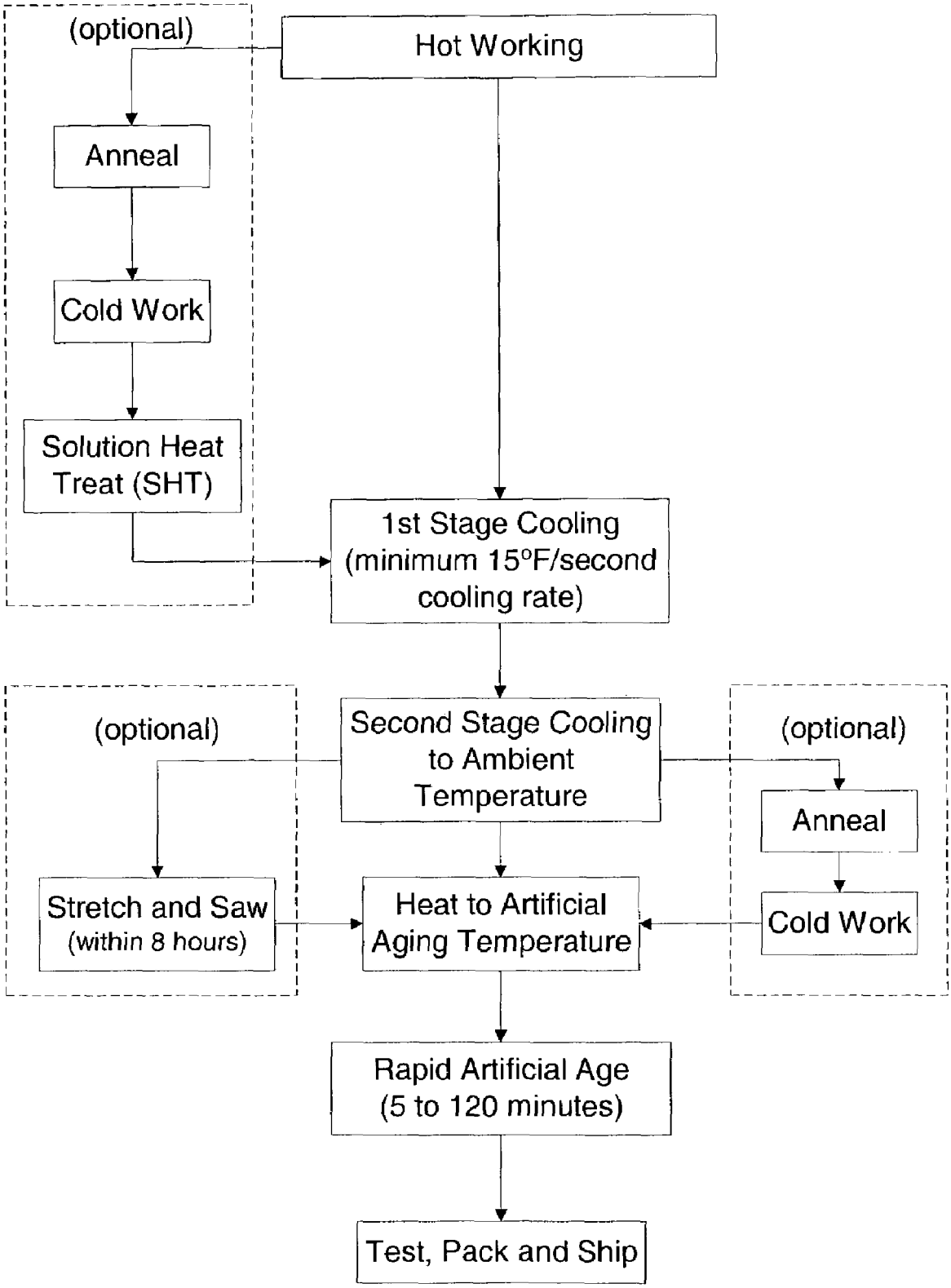
FIG. 1 is a flowchart for shortening the production time and rapid aging of heat treatable aluminum alloys according to the present invention.
Figure 4:
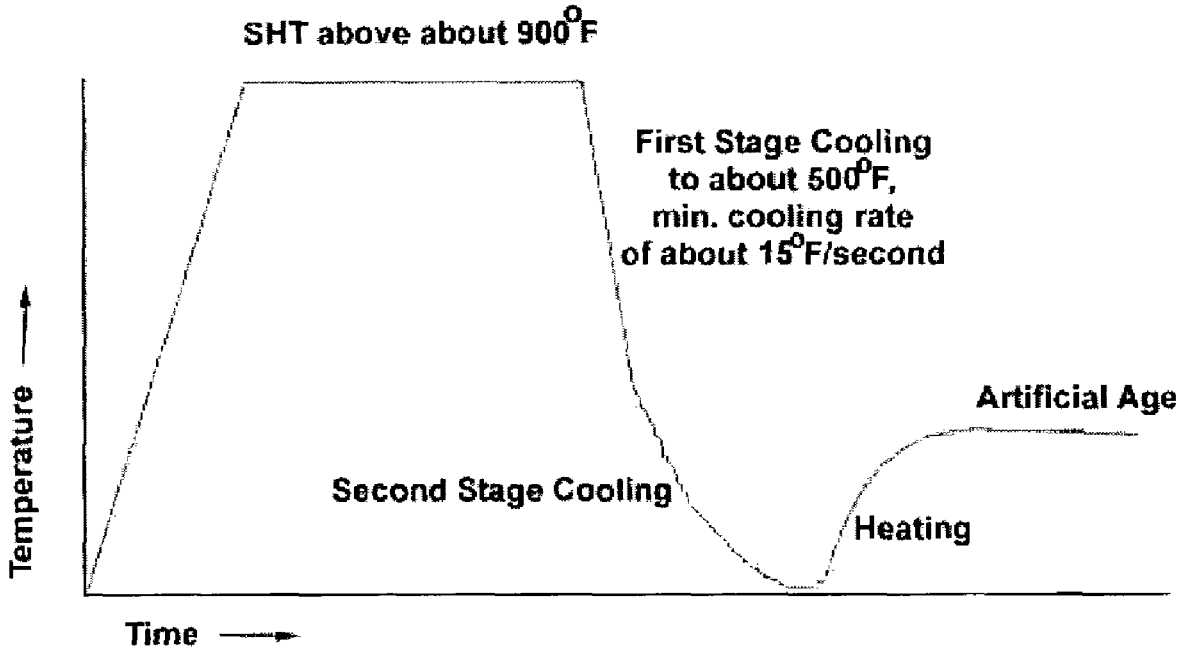
FIG. 4 is schematic representation of a temperature—time plot for one preferred embodiment of this invention showing two-stage cooling to ambient temperature using different cooling rates.

Turning first to FIG. 1 and FIG. 4, there is illustrated a process flowchart and a temperature versus time schematic diagram, respectively, for shortening the production time and rapid aging of heat treatable aluminum alloys according to the present invention. The essential steps of this invention are outlined in the central vertical trunk of the flowchart of FIG. 1. Optional processing steps are presented in the lateral branches of the flowchart of FIG. 1. In this preferred embodiment, a heat treatable aluminum alloy is subjected to hot working at a solutionizing temperature to form a wrought product, product form, or simply a product. A solutionizing temperature is defined as a temperature at which the alloying elements have maximum solubility in the aluminum solid solution, while avoiding equilibrium melting. After exposing a heat treatable aluminum alloy at a solutionizing temperature for a sufficient period to dissolve the alloying elements into solid solution, the alloy is solutionized. Typically, heat treatable aluminum alloys can be solutionized at temperatures above about 900° F. Hot working includes extruding, rolling, and forging the alloy, or any other form of thermomechanical processing that is available to one skilled in the art. Product forms include extrusions of various shapes, sheet, plate, and forgings.

After hot working, the alloy is subjected to first stage cooling or quenching, as depicted in FIG. 1 and FIG. 4. The first stage cooling rate is chosen to be rapid enough to keep the alloying elements in solution at temperatures closer to ambient temperature. In this condition, the solid-state solution of the alloy is said to be in a supersaturated condition. The minimum first stage cooling rate should be about 15° F. per second, and preferably is about 25° F. per second. First stage cooling should proceed to a lower temperature or critical temperature at which precipitation of second phase particles does not significantly occur. A first stage cooling lower temperature, also referred to as a first stage critical temperature or simply as a critical temperature, that is suitable for many heat treatable aluminum alloys is about 500° F., but it is recognized that the first stage cooling lower temperature can be any temperature at which second phase precipitation is negligible. It is further recognized that the quenching or cooling means and medium are not critical to this invention. As long as the minimum cooling rate is met, the cooling can be achieved by immersing, flooding, spraying or other cooling means that is known to those skilled in the art; or by air quenching, water quenching, aqueous solution quenching, oil quenching, molten metal quenching or quenching with any other medium that is familiar to those skilled in the art.

For purposes of this invention, a maximum cooling rate is not specified. However, it is realized that a range of optimum first stage cooling rates can exist. An optimum first stage cooling rate is one in which the requirement of keeping the alloying elements in solid state solution is met, while further providing that the cooling rate is not high enough for thermal stresses, which occur in the alloy during cooling, to cause distortion or deformation of the alloy product form. Quenching at high cooling rates can cause thermal stresses that are of greater magnitude than the inherent mechanical strength of the alloy. For example, a press-quenched extrusion can be significantly deformed or warped by thermal stresses. Deformed extrusions must be stretched to relieve the thermally induced stresses and strains and to return the product form to the originally intended shape. Stretching adds additional costs to the final product, including process costs from the additional stretching step and associated handling, and capital costs incurred by requiring a stretching machine. By using an optimum first stage cooling rate, as defined herein, adding a stretching step in the process flow path is not required.

It is additionally anticipated that the objects of this invention can be met with aluminum casting alloys, or with as-cast wrought aluminum alloys, which are not substantially hot worked. When an aluminum alloy casting or as-cast wrought aluminum alloy is cooled from a solutionizing temperature, utilizing a minimum first stage cooling rate that is rapid enough to keep the alloying elements in solution at temperatures closer to ambient temperature, the rapid artificial aging practice of this invention can be used to strengthen the cast alloy. Examples of aluminum casting alloys appropriate for this invention include, but are not limited to: A356, A357, and A319. Preferred as-cast wrought aluminum alloys for use with this invention include 2000, 6000 and 7000 series alloys, and more specifically aluminum alloys: 2024, 2026, 2124, 6061, 6063, 6022, 6111, 6082, 6013, 6005, 6009, 6016, 6181, 6260, 6963, 6060, 7050, 7055, 7075, 7085, and 7150.

Figure 5:
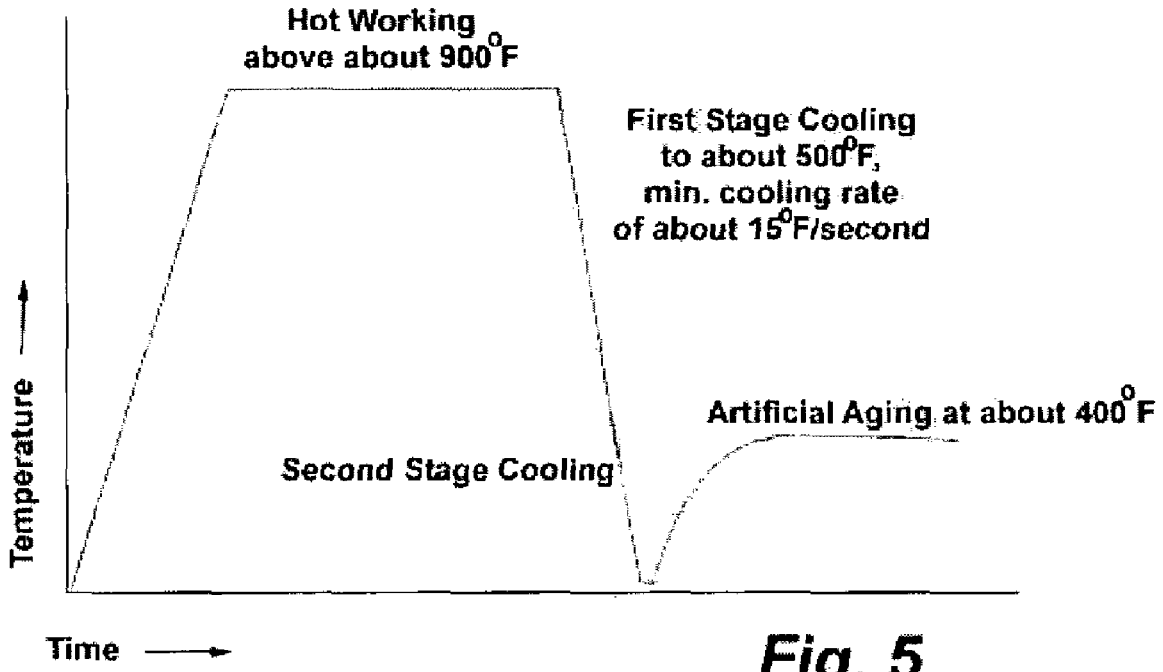
FIG. 5 is a schematic representation of a temperature—time plot for another preferred embodiment of this invention showing two stage cooling to ambient temperature using the same cooling rate.

In an embodiment of the invention depicted in FIG. 1 and FIG. 4, after the first stage cooling, the alloy is subjected to a second stage cooling to ambient temperature. The rate of second stage cooling is not critical for the practice of this invention. Furthermore, it is recognized that the second stage cooling need not reduce the temperature of the alloy entirely to ambient or room temperature, and that second stage cooling could proceed to any desired temperature below that of the critical first stage temperature. While the invention specifies two stages of cooling, it should be additionally recognized that the second stage cooling rate could be the same as the first stage cooling rate, as long as the equivalent cooling rates are sufficiently high enough to minimize precipitation of second phase particle at temperatures above the first stage critical temperature. Referring to FIG. 5, a time temperature plot is presented for the embodiment of the instant invention where the first and second stage cooling rates are equivalent and sufficiently high to prevent precipitation.

With continuing reference to FIG. 1, FIG. 4 and FIG. 5, it is seen that following second stage cooling to ambient, or near ambient temperature, the alloy is then heated to an artificial aging temperature. It is desirable to begin heating to artificial aging temperature as soon as possible after second stage cooling in order to minimize natural aging. Any natural aging that might occur before heating to the artificial aging temperature should be inadvertent, and occur during optional steps in the practice of this invention. For example, natural aging could occur during sawing and stretching processes.

Data that are presented later in the Examples indicate that any inadvertent natural aging should be limited to less than about eight hours. The step of heating to artificial aging temperature should occur within eight hours after second stage cooling. Preferably, heating to artificial aging temperature should begin within four hours after second stage cooling. More preferably, heating to artificial aging temperature should begin within one hour after second stage cooling. Most preferably, heating to artificial aging temperature should begin immediately after second stage cooling. The heating rate to artificial aging temperatures is not specified for this invention, but it is realized that faster heating rates will shorten the time required to practice this invention.

As seen in FIG. 1 and FIG. 4 after heating to artificial aging temperature, the product is soaked or held at the artificial aging temperature for a predetermined artificial aging time. Preferred artificial aging temperatures used in this invention are temperatures from about 350° F. to about 400° F., inclusive, including all fractional values of temperature within this range. Further, it is to be appreciated that optimum artificial aging temperatures are dependent in part upon the composition of the specific alloy that is to be artificially aged.

It is recognized by those skilled in the art that useful or optimum artificial aging temperatures may vary out of the stated preferred range, and that any experimentally determined useful or optimum artificial aging temperature for a particular heat treatable aluminum alloy is anticipated by and incorporated into this invention.

Figure 3:
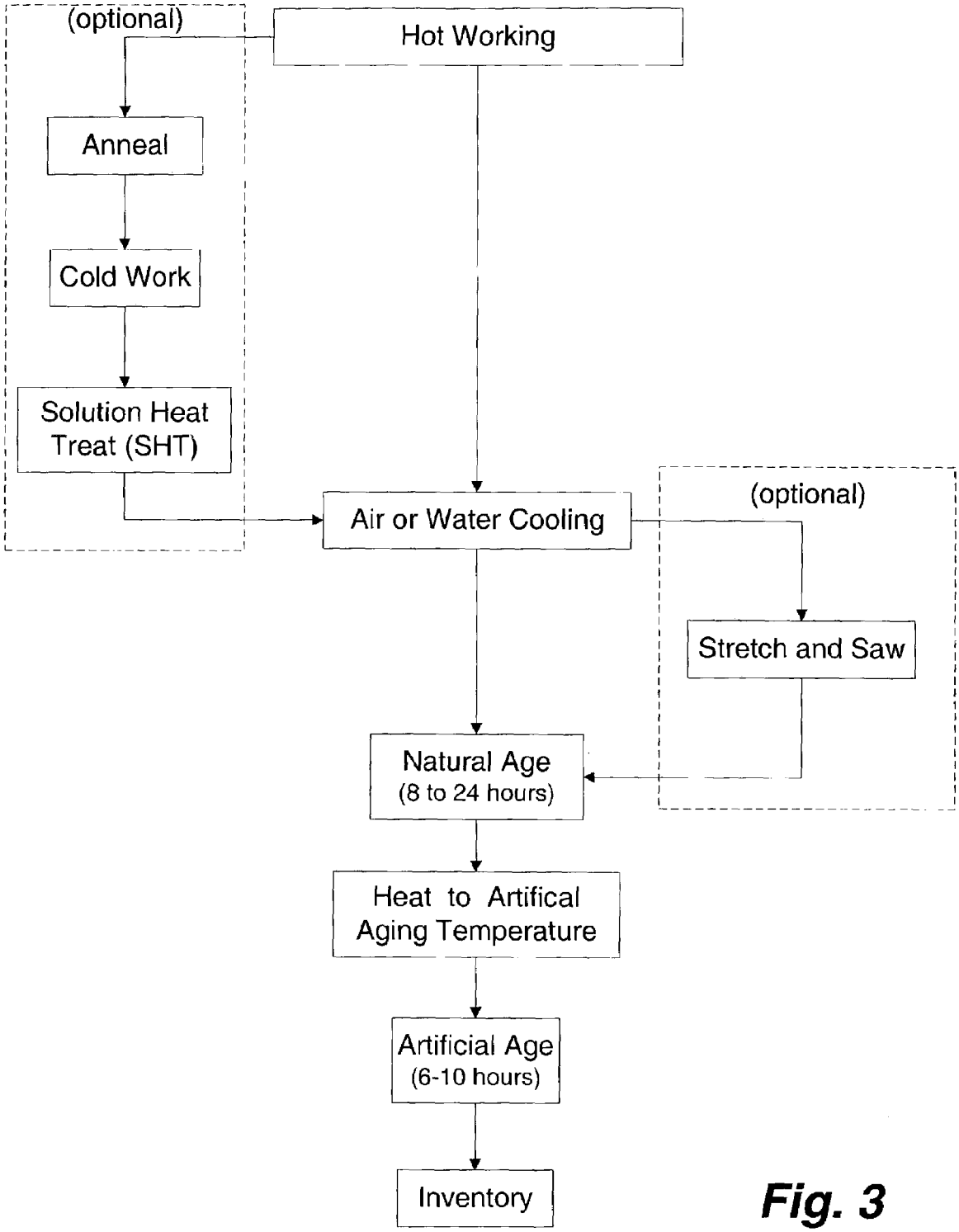
Fig. 3 (Prior Art)
FIG. 3 is a flowchart of prior art for the production of heat treatable aluminum alloys.

Preferred artificial aging times for this invention can be as low as about 5 minutes and up to about 120 minutes. This artificial aging time is significantly less than the prior art artificial aging time of 6 to 8 hours (FIG. 3), and hence the artificial aging time of this invention is termed rapid aging.

In certain instances, however, it may be desirable to use artificially aging times longer than 120 minutes. For example, in certain 7xxx series aluminum alloys (aluminum-zinc alloys), artificial aging for a period of time that is longer than what is required to attain peak strength is purposely practiced to increase the corrosion resistance of the alloy, or make the alloy less susceptible to stress corrosion cracking. This practice is referred to as "overaging." The overaged product usually exhibits a slight decrease in strength, but also a significant decrease in susceptibility to stress corrosion cracking.

It is recognized that artificial aging times for this invention can exceed the upper bound of the preferred range stated previously, and in such instance, the practice would still be covered by the teachings of the instant invention.

After artificial aging, the heat-treated aluminum alloy of this invention is typically allowed to air cool to ambient temperature. Upon cooling, the products of this invention can be inspected, tested for properties, packed, and shipped to customers or end-users. The products of this invention can be subjected to further fabrication steps known to those of ordinary skill in the art, such as but not limited to, anodizing, machining and forming, and then can be resold as finished or semi-finished parts.

Figure 2:
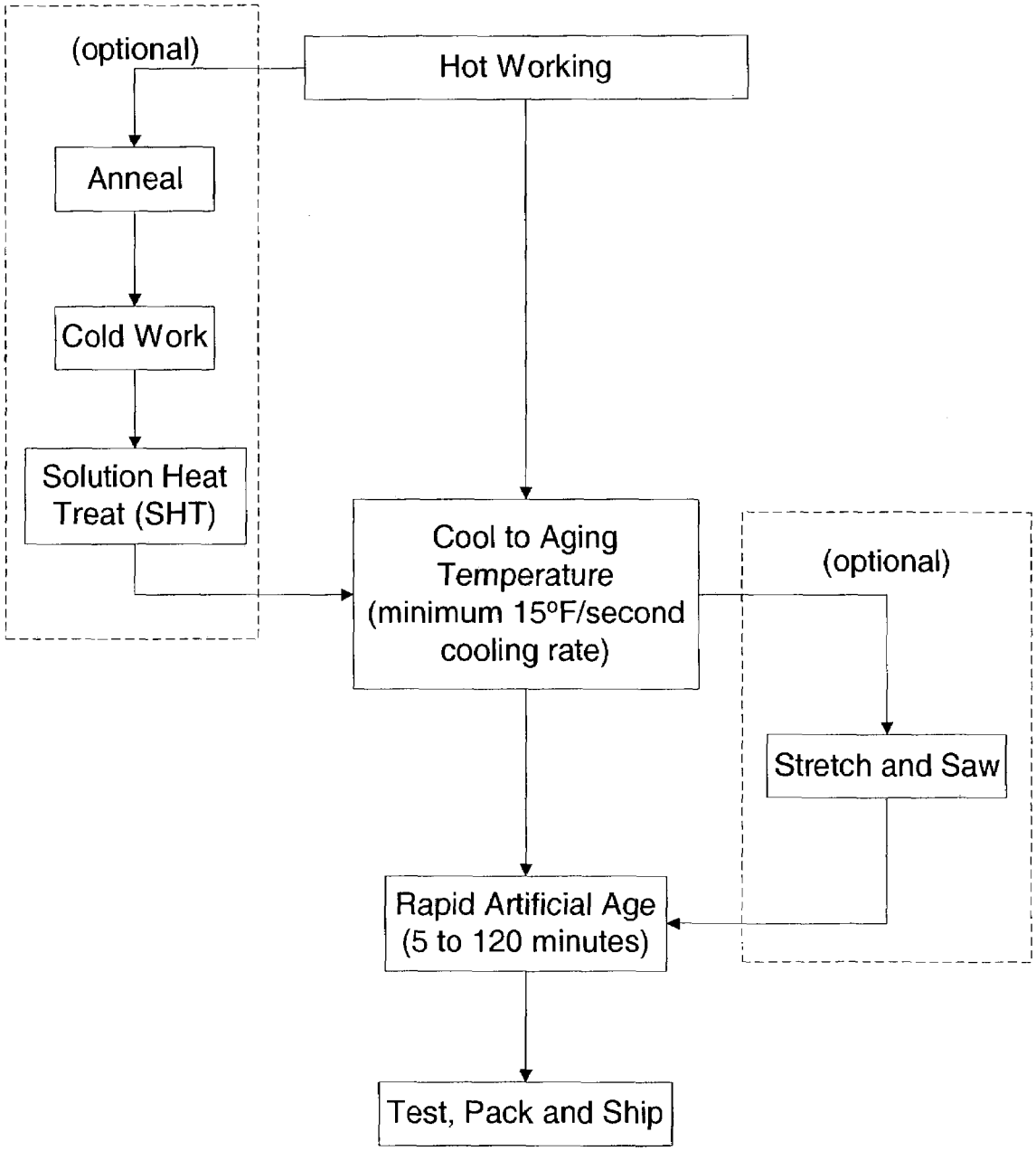
FIG. 2 is a flowchart of another embodiment for shortening the production time and rapid aging of heat treatable aluminum alloys according to the present invention.
Figure 6:
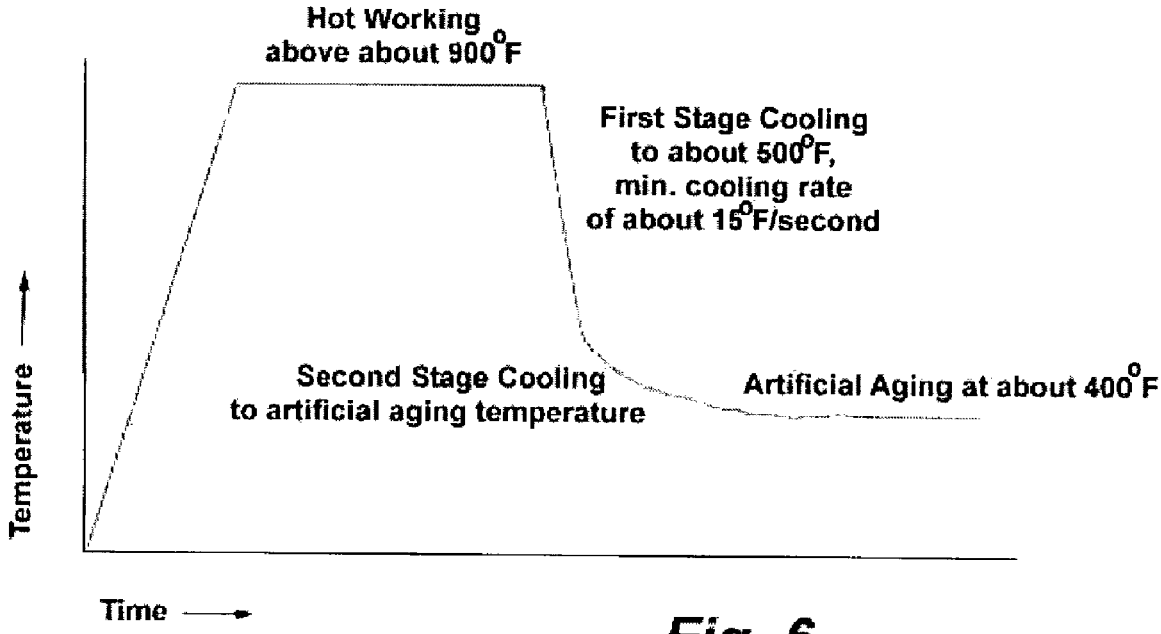
FIG. 6 is a schematic representation of a temperature—time plot for yet another preferred embodiment showing cooling to aging temperature.

An additional preferred embodiment of this invention is summarized by the flowchart presented in FIG. 2 and FIG. 6. As per the previously described embodiment, the alloy undergoes that steps of: 1) hot working at a solutionizing temperature and 2) first stage cooling to a critical temperature using a minimum cooling rate of about 15° F. per second. In this embodiment, the second stage cooling step takes the temperature of the product to its predetermined artificial aging temperature. The product is then artificially aged for about 5 to 120 minutes. The discussions about cooling means, cooling media, artificial aging times and artificial aging temperatures, which were included with the previously described preferred embodiments (FIG. 1, FIG. 4 and FIG. 5), also apply to the current preferred embodiment (FIG. 2 and FIG. 6).

As previously indicated, the instant invention is suitable for all types of wrought heat treatable aluminum alloys. For example, referring to FIG. 1 and FIG. 2, the center trunk of the flow chart could describe the manufacture of alloy extrusions or rolled plate. For the production of rolled sheet, after hot working and before first stage cooling, the optional steps of annealing, cold working, and a furnace solution heat treatment may be employed, as shown on FIG. 1 and FIG. 2. Extrusions, and other wrought forms, may be sawed and/or stretched, typically before the artificial aging step of this invention, but it is conceivable that these optional steps could occur after artificial aging, as long as the capacity of the stretcher machine was sufficient to stretch the artificially aged products. For forged products, it may be beneficial to employ the optional steps of annealing and cold forging after either first stage or second stage cooling.

It should be realized that the total duration of any optional steps after second stage cooling are not exceed 8 hours. The hot worked and cooled product of this invention should be heated to artificial aging temperature within 8 hours of cooling.

The benefit of the present invention is illustrated in the following examples.

EXAMPLES 1-18

To demonstrate the practice of the present invention and the advantages thereof, aluminum alloy 6061 extrusions were subjected to the methods of this invention. A billet of aluminum alloy 6061 was extruded to a 1-inch rod. Tensile test specimens were machined per ASTM Method B557. Duplicate specimens were machined next to each other from the 1" rod.

In order to solutionize the tensile specimens, and to simulate extruding at a solutionizing temperature, the tensile specimens were subjected to a furnace solution heat treatment at 1000° F. for 3 minutes at temperature. The specimens were then first stage cooled to about 500° F. by quenching in water. For these specimens, the water quench rate is greater than 400° F. per second. The specimens were then second stage cooled in water to ambient temperature. In Examples 1-9, tensile specimens were allowed to naturally age at ambient temperature for 15 minutes, and then the specimens were further grouped and rapidly heated to different artificial aging temperatures in a Wood's metal bath. In Examples 10-18, tensile specimens were naturally aged at ambient temperature for 8 hours, and then the specimens were further grouped and rapidly heated to different artificial aging temperatures in a Wood's metal bath. Artificial aging temperatures of 350° F., 375° F. and 400° F. were used in these examples. All of the artificially aged samples were tensile tested according to ASTM Method B557 for mechanical properties. The results of the tensile tests are found in FIG. 7-FIG. 9 and Table 1.

TABLE 1

Figure 7:
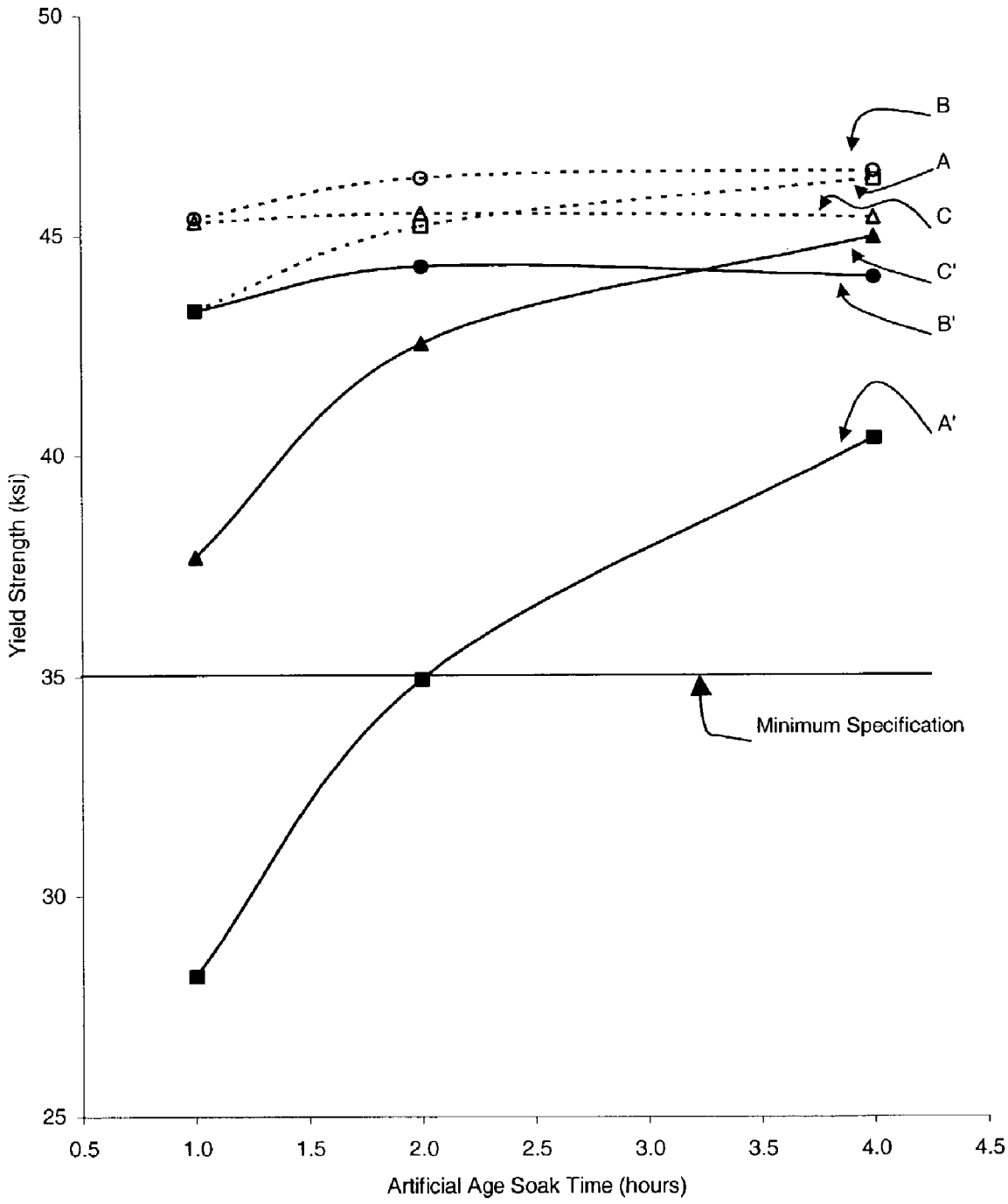
FIG. 7 are plots of mechanical testing data showing tensile yield strengths for aluminum alloy 6061 processed according to the method of this invention with two minutes of unintentional natural aging and prior art method with eight hours of intentional natural aging.
Figure 8:
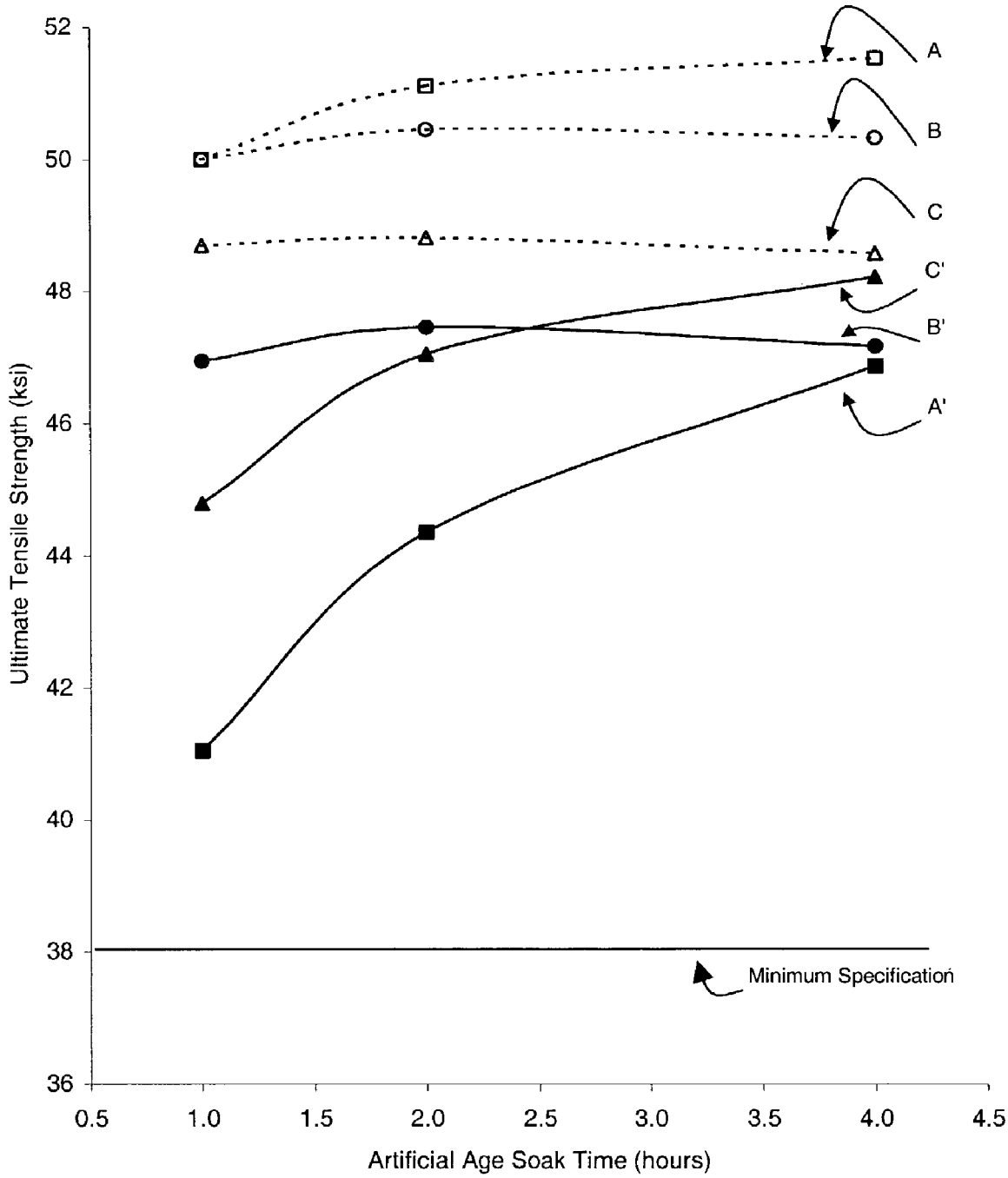
FIG. 8 are plots of mechanical testing data showing ultimate tensile strengths for aluminum alloy 6061 processed according to the method of this invention with two minutes of unintentional natural aging and prior art method with eight hours of intentional natural aging.
Figure 9:
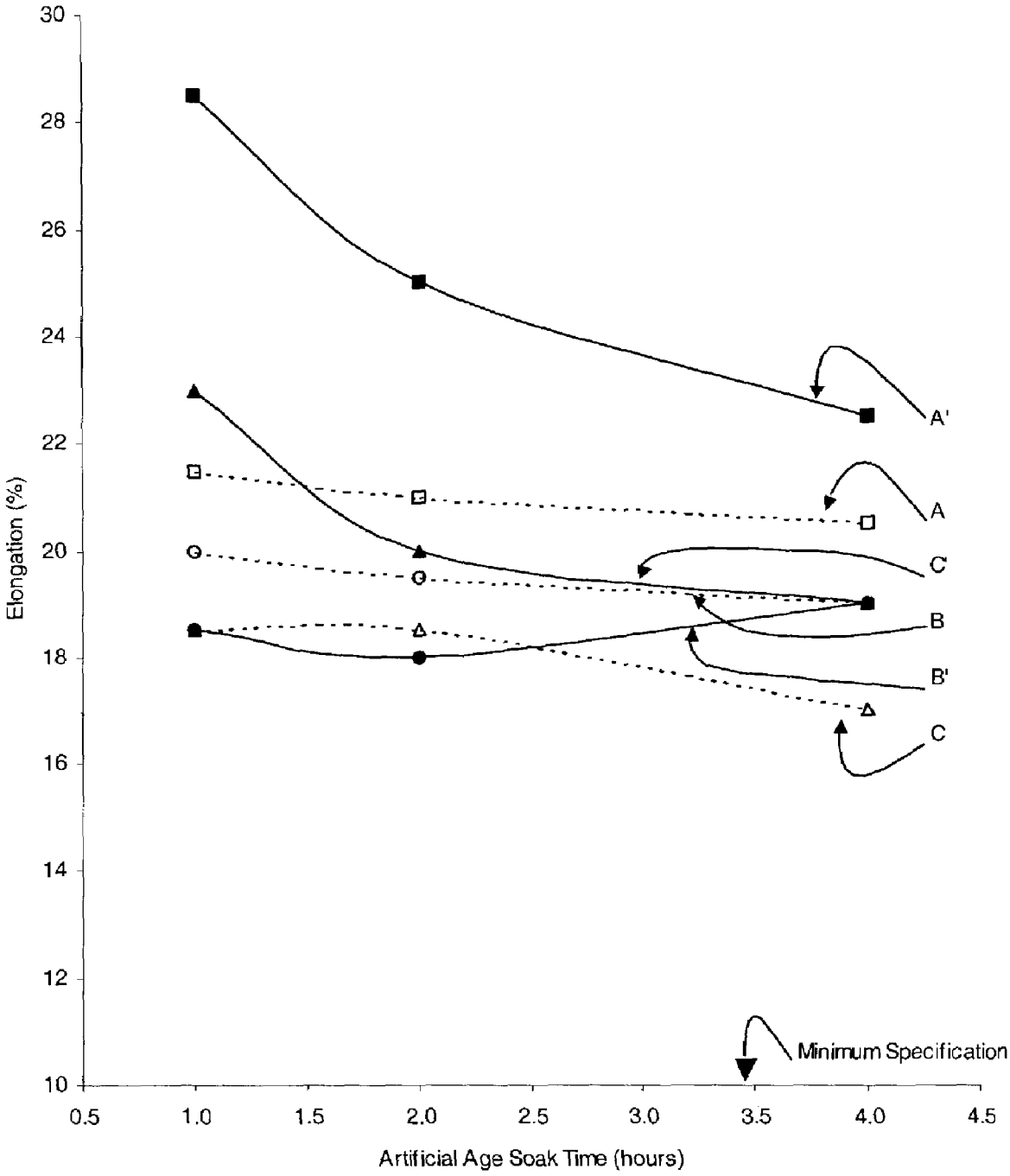
FIG. 9 are plots of mechanical testing data showing percent elongation for aluminum alloy 6061 processed according to the method of this invention with two minutes of unintentional natural aging and a prior art method with and eight hours of intentional natural aging.

| Example Number | Curve in FIGS. 7-9 | First Stage Cooling Rate (° F./s) | Natural Aging Time (min.) | Artificial Aging Temp. (° F.) | Artificial Aging Time (h) | Tensile Yield Strength (ksi) | Ultimate Tensile Strength (ksi) | Percent Elongation |
|---|---|---|---|---|---|---|---|---|
| 1 | A | >400 | 15 | 350 | 1 | 43.3 | 50.0 | 21.5 |
| 2 | A | >400 | 15 | 350 | 2 | 45.2 | 51.1 | 21.0 |
| 3 | A | >400 | 15 | 350 | 4 | 46.3 | 51.5 | 20.5 |
| 4 | B | >400 | 15 | 375 | 1 | 45.4 | 50.0 | 20.0 |
| 5 | B | >400 | 15 | 375 | 2 | 46.3 | 50.5 | 19.5 |
| 6 | B | >400 | 15 | 375 | 4 | 46.5 | 50.3 | 19.0 |
| 7 | C | >400 | 15 | 400 | 1 | 45.3 | 48.7 | 18.5 |
| 8 | C | >400 | 15 | 400 | 2 | 45.5 | 48.8 | 18.5 |
| 9 | C | >400 | 15 | 400 | 4 | 45.4 | 48.6 | 17.0 |
| 10 | A' | >400 | 480 | 350 | 1 | 28.2 | 41.1 | 28.5 |
| 11 | A' | >400 | 480 | 350 | 2 | 35.0 | 44.4 | 25.0 |
| 12 | A' | >400 | 480 | 350 | 4 | 40.4 | 46.9 | 22.5 |
| 13 | B' | >400 | 480 | 375 | 1 | 43.3 | 47.0 | 18.5 |
| 14 | B' | >400 | 480 | 375 | 2 | 44.3 | 47.5 | 18.0 |
| 15 | B' | >400 | 480 | 375 | 4 | 44.1 | 47.2 | 19.0 |
| 16 | C' | >400 | 480 | 400 | 1 | 37.7 | 44.8 | 23.0 |
| 17 | C' | >400 | 480 | 400 | 2 | 42.6 | 47.1 | 20.0 |
| 18 | C' | >400 | 480 | 400 | 4 | 45.0 | 48.2 | 19.0 |

The graphic representation of the tensile test data in FIG. 7-FIG. 9 demonstrate the validity of rapid aging of the current invention, and demonstrate the detriment of lengthy natural aging to this invention. As described above, any natural aging that occurs during the practice of this invention should be inadvertent and minimal. Tensile yield strength data found in FIG. 7 show that with 15 minutes of natural aging (Examples 1-3, 4-6, and 7-9; corresponding to curves A, B, and C respectively), only 1 hour of artificial aging at temperatures between 350° F. and 400° F. was required to provide tensile strengths around 45 ksi (thousand-pounds per square inch). These values of tensile strength are significantly higher than the minimum yield strength specification of 35 ksi for alloy 6061-T6. The advantage of the instant invention is clear when it is recognized that to achieve comparable mechanical properties, the prior art practice (see FIG. 3) utilizes 8-24 hours of natural aging combined with 6-10 hours of artificial aging, whereas the practice of the instant invention eliminates or minimizes natural aging and requires only about 5 to about 120 minutes of artificial aging.

When the alloys were naturally aged for 8 hours, and subsequently artificially aged for 1 or 2 hours at 350° F., the Examples 10-11 (curve A' of FIG. 7) did not meet minimum the specification of 35 ksi. While the 8-hour naturally aged specimens that were artificially aged at 375° F. and 400° F. (Examples 13-15 and 16-18, curves B' and C', respectively) met minimum specification at all temperatures, the values were generally lower than those with only 15 minutes natural aging (Examples 1-9). The detrimental effect of natural aging on yield stress is clear from the data presented in FIG. 7.

FIG. 8 illustrates that the same trends are observed for ultimate tensile strengths. Minimum specified ultimate tensile strength is 38 ksi for 6061-T6 and the rapid aging practice of this invention provides ultimate tensile strengths that are greater than 48 ksi (Examples 1-3, 4-6, and 7-9; curves A, B, and C, respectively). The detrimental effect of lengthy natural aging to the practice of this invention is also observed as lower ultimate tensile strengths (Examples 10-12, 13-15, 16-18; curves A', B', and C', respectively).

FIG. 9 illustrates that the both the rapid aging practice and prior art practice resulted in adequate percent elongation. The minimum specification for this property for 6061-T6 is 10%. All of the Examples 1-18 met this specification.

EXAMPLES 19-30

To further demonstrate the practice of the present invention and particularly the effect of first stage cooling rate on mechanical strengths, a billet of aluminum alloy 6061 was extruded to a 1-inch rod. Tensile test specimens were machined per ASTM Method B557. Duplicate specimens were machined next to each other from the 1-inch rod. In order to solutionize the tensile specimens, and to simulate extruding at a solutionizing temperature, the tensile specimens were subjected to a furnace solution heat treatment at 1025° F. for 2 minutes at temperature.

The specimens were then first stage cooled to about 500° F. by quenching in ambient air or in water maintained at different temperatures. For example, to achieve a first stage cooling rate of about 80° F./s (Examples 28-30, curve G in FIGS. 10-12), the specimens were immersed in water maintained at 100° F. Other first stage cooling rates were approximately 5° F./s, 25° F./s and 38° F./s (Examples 19-21, 22-24, 25-7; curves D, E, and F, respectively, in FIGS. 10-12). The specimens were then second stage cooled to ambient temperature. All tensile specimens in this experiment were allowed to naturally age at ambient temperature for no longer than 2 minutes, and then the specimens were rapidly heated to an aging temperature of 400° F. in a Wood's metal bath. All of the artificially aged samples were tensile tested according to ASTM Method B557 for mechanical properties.

Figure 10:
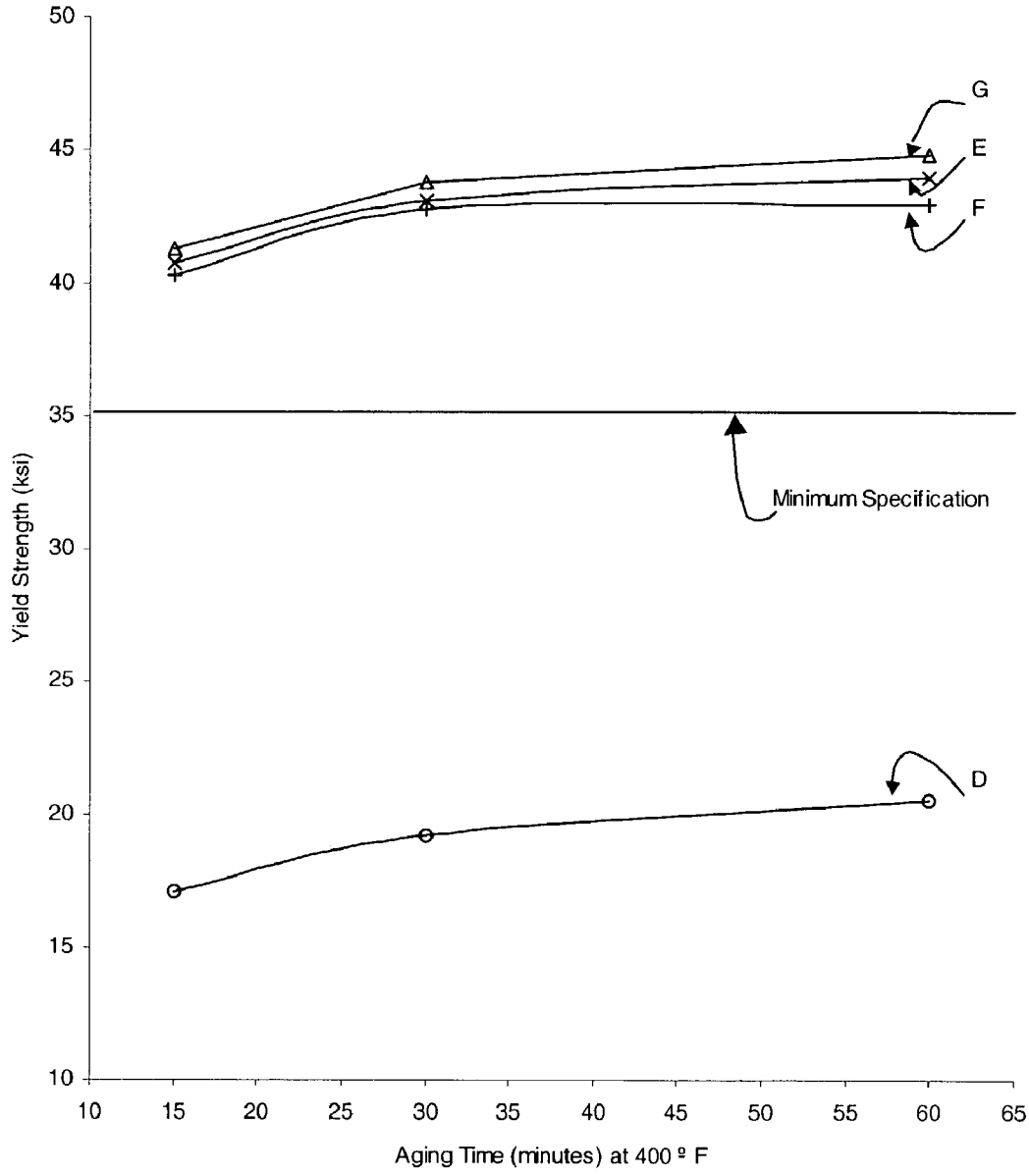
FIG. 10 are plots of mechanical testing data showing the effect of changing cooling rates after solution heat treatment of aluminum alloy 6061 with two minutes unintentional natural aging prior to artificial aging on tensile yield strengths.
Figure 11:
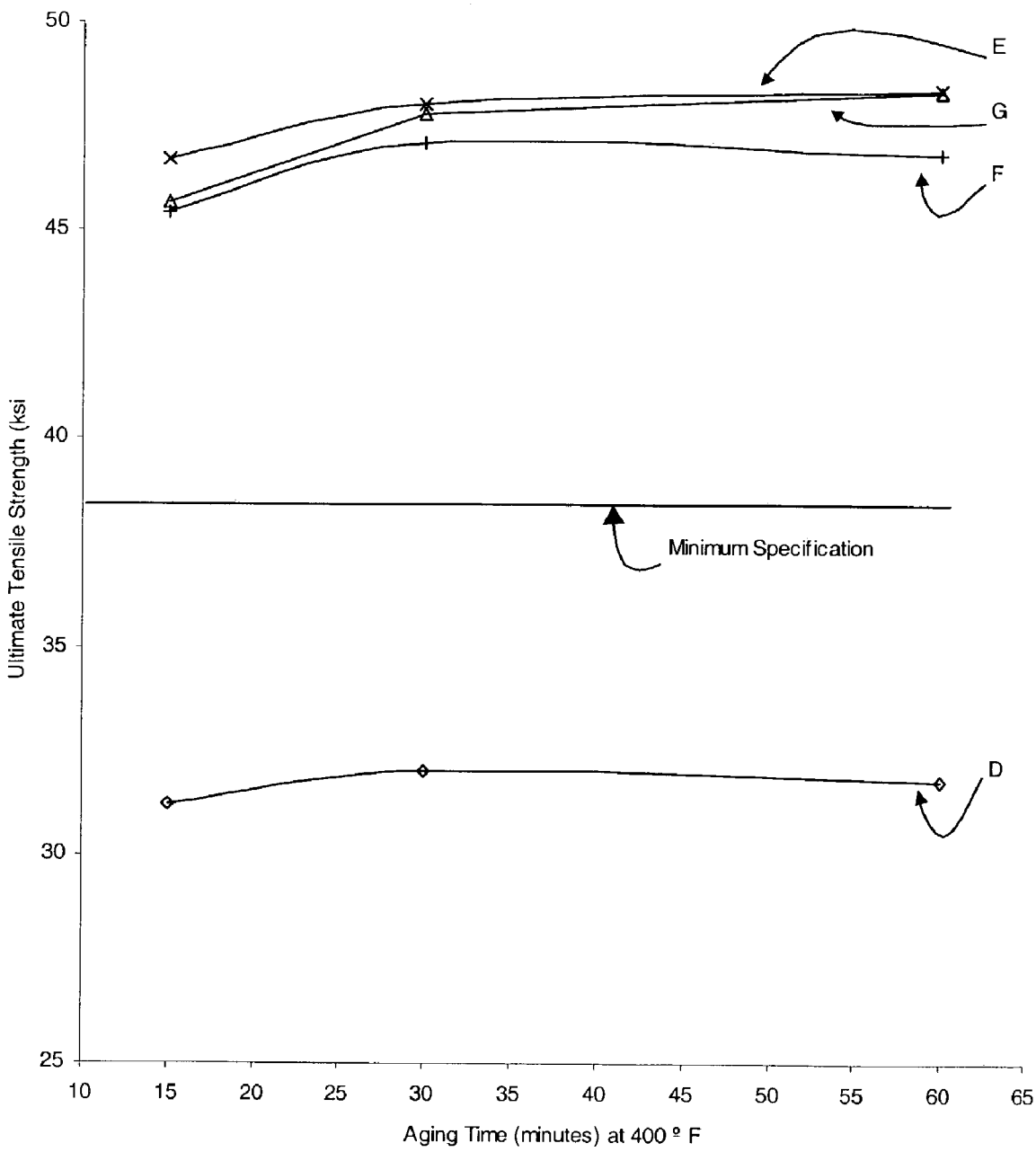
FIG. 11 are plots of mechanical testing data showing the effect of changing cooling rates after solution heat treatment of aluminum alloy 6061 with two minutes unintentional natural aging prior to artificial aging on ultimate tensile strengths.
Figure 12:
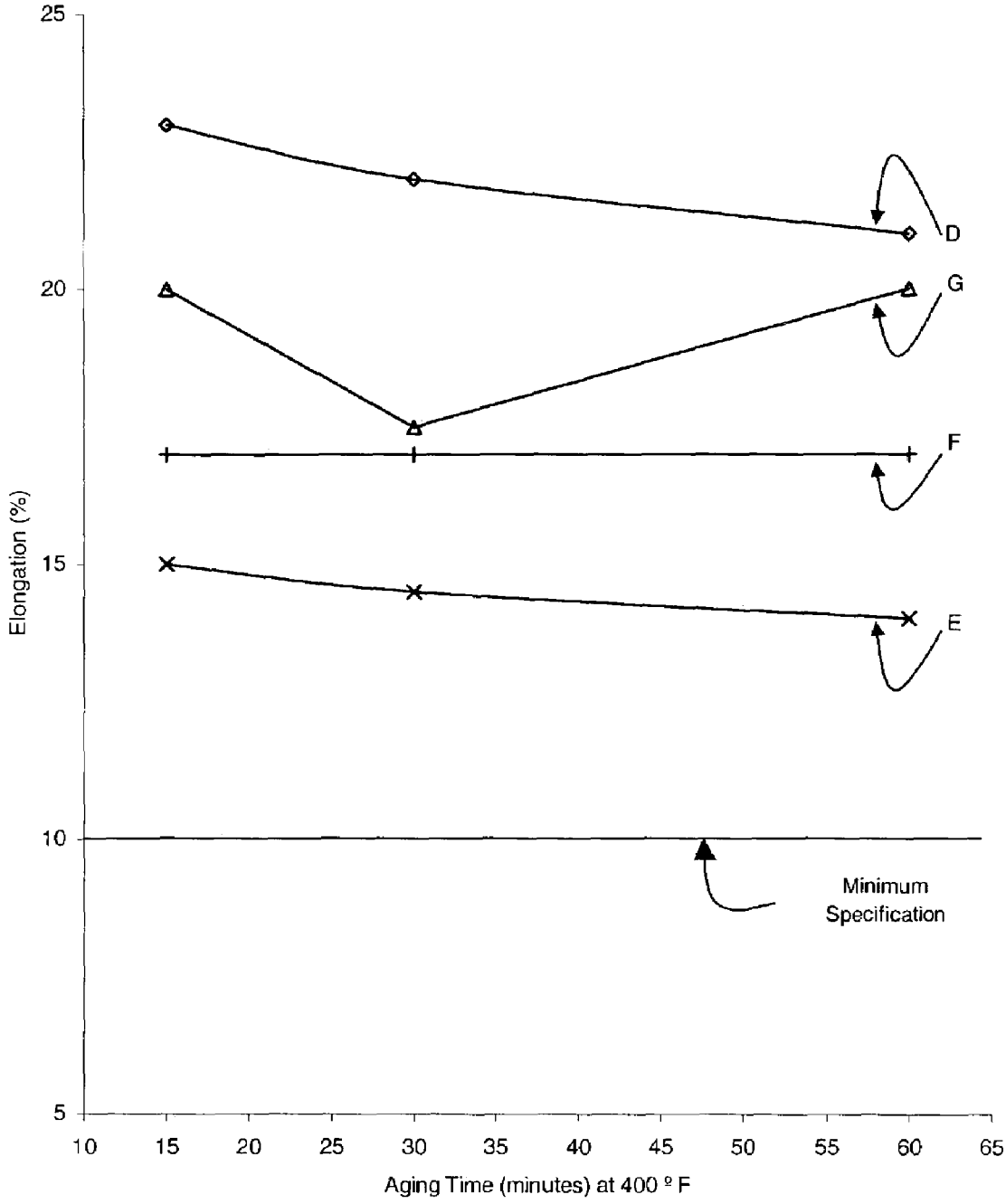
FIG. 12 are plots of mechanical testing data showing the effect of changing cooling rates after solution heat treatment of aluminum alloy 6061 with two minutes unintentional natural aging prior to artificial aging on percent elongation.

FIGS. 10-12 and Table 2 provide data that demonstrate the effect of first stage cooling rate on the practice of this invention. Examples 19-21 (curve D) were first stage cooled at 5°/s. None of the specimens in this group met the minimum specifications for yield strength (FIG. 10) or ultimate tensile strength (FIG. 11). Examples 22-24, 25-27, and 28-30 (curves E, F, and G, respectively) show data from specimens that were first stage cooled at 25° F./s or greater, and which exhibited significantly higher yield strengths and ultimate tensile strengths than the minimum specifications for 6061-T6.

FIG. 12 shows that all specimens had sufficient percent elongation to meet the 6061-T6 specification for elongation.

The data in FIGS. 10-12 and Table 2 predict that when first stage cooling is about 15° F./s or greater and when natural aging is short and inadvertent, rapid artificial aging for as little as 5 minutes at 400° F. is sufficient to provide mechanical strengths that meet specifications for 6061-T6.

The data in FIGS. 10-12 and Table 2 demonstrate that when first stage cooling is about 25° F./s or greater and when natural aging is short and inadvertent, rapid artificial aging for as little as 15 minutes at 400° F. is sufficient to provide mechanical strengths that meet specifications for 6061-T6.

TABLE 2

| Example Number | Curve in FIGS. 10-12 | First Stage Cooling Rate (° F./s) | Natural Aging Time (min.) | Artificial Aging Temp. (° F.) | Artificial Aging Time (h) | Tensile Yield Strength (ksi) | Ultimate Tensile Strength (ksi) | Percent Elongation |
|---|---|---|---|---|---|---|---|---|
| 19 | D | 5 | 2 | 400 | 0.25 | 17.1 | 31.2 | 23.0 |
| 20 | D | 5 | 2 | 400 | 0.5 | 19.2 | 32.0 | 22.0 |
| 21 | D | 5 | 2 | 400 | 1 | 20.5 | 31.8 | 21.0 |
| 22 | E | 25 | 2 | 400 | 0.25 | 40.8 | 46.7 | 15.0 |
| 23 | E | 25 | 2 | 400 | 0.5 | 43.1 | 48.0 | 14.5 |
| 24 | E | 25 | 2 | 400 | 1 | 44.0 | 48.4 | 14.0 |
| 25 | F | 38 | 2 | 400 | 0.25 | 40.3 | 45.5 | 17.0 |
| 26 | F | 38 | 2 | 400 | 0.5 | 42.8 | 47.1 | 17.0 |
| 27 | F | 38 | 2 | 400 | 1 | 43.0 | 46.8 | 17.0 |
| 28 | G | 80 | 2 | 400 | 0.25 | 41.3 | 45.7 | 20.0 |
| 29 | G | 80 | 2 | 400 | 0.5 | 43.8 | 47.8 | 17.5 |
| 30 | G | 80 | 2 | 400 | 1 | 44.8 | 48.3 | 20.0 |

Having described the presently preferred embodiments, it is to be understood that the invention may be otherwise embodied within the scope of the claims.

We claim:

1. A method for producing a heat-treated 6061 series aluminum alloy extrusion in a shortened period of time, said method comprising:

(a) providing a billet comprised of an aluminum alloy selected from the 6061 series of aluminum alloys;

(b) homogenizing said billet;

(c) cooling said billet;

(d) reheating said billet;

(e) extruding said billet above 900° F. to form an extrusion;

(f) first stage cooling said extrusion to about 500° F., wherein a first stage cooling rate is from about 25° F. per second to about 80° F. per second, wherein said first stage cooling rate is below a critical cooling rate so said extrusion is essentially free of thermal stress distortion;

(g) second stage cooling said extrusion to ambient temperature;

(h) heating said extrusion to an artificial aging temperature of 350° F. to 400° F. within about eight hours after second stage cooling; and (i) artificially aging said extrusion at said artificial aging temperature for about 5 to about 120 minutes to form said heat-treated 6061 series aluminum alloy extrusion in a peak strength temper.

2. The method of claim 1, further comprising stretching said extrusion within about eight hours after said second stage cooling of (g) and before said heating of (h).

3. The method of claim 1, further comprising sawing said extrusion within about eight hours after said second stage cooling of (g) and before said heating of (h).

4. The method of claim 1, further comprising stretching and sawing said extrusion within about eight hours after said second stage cooling of (g) and before said heating of (h).

5. The method of claim 1, further comprising cooling said heat-treated 6061 series aluminum alloy extrusion of (i) to said ambient temperature.

6. The method of claim 5, further comprising anodizing said heat-treated 6061 series aluminum alloy extrusion.

7. The method of claim 1, wherein said heating of said extrusion to said artificial aging temperature of about 340° F. to 400° F. is within about 15 minutes or less after the second stage cooling.

8. The method of claim 1, wherein the heating of the extrusion to the artificial aging temperature of about 340° F. to about 400° F. within about 4 hours after the second stage cooling.

9. A method for producing a heat-treated 6061 aluminum alloy extrusion in a shortened period of time, said method comprising:

(a) providing an aluminum alloy billet comprised of aluminum alloy 6061;

(b) homogenizing said billet;

(c) cooling said billet;

(d) reheating said billet;

(e) extruding said billet above 900° F. to form an extrusion;

(f) first stage cooling said extrusion to about 500° F., wherein a first stage cooling rate is from about 25° F. per second to about 80° F. per second, wherein said first stage cooling rate is below a critical cooling rate so said extrusion is essentially free of thermal stress distortion;

(g) second stage cooling said extrusion to ambient temperature;

(h) heating said extrusion to an artificial aging temperature ranging from about 350° F. to about 400° F. within about eight hours after the second stage cooling; and (i) artificially aging said extrusion at said artificial aging temperature for about 5 to about 120 minutes to form said heat treated 6061 aluminum alloy extrusion in a peak strength temper.

10. The method of claim 9, wherein the heating of the extrusion to the artificial aging temperature of about 340° F. to about 400° F. within about 4 hours after the second stage cooling.

11. The method of claim 10, further comprising stretching said extrusion within about eight hours after said second stage cooling of (g) and before said heating of (h).

12. The method of claim 10, further comprising sawing said extrusion within about eight hours after said second stage cooling of (g) and before said heating of (h).

13. The method of claim 10, further comprising stretching and sawing said extrusion within about eight hours after said second stage cooling of (g) and before said heating of (h).

14. The method of claim 10, further comprising cooling said heat-treated 6061 aluminum alloy extrusion of (i) to said ambient temperature.

15. The method of claim 14, further comprising anodizing said heat-treated 6061 aluminum alloy extrusion.

16. The method of claim 10, wherein said heating of said extrusion to said artificial aging temperature of about 340° F. to about 400° F. is within about 15 minutes or less after the second stage cooling.

17. A method for producing a heat-treated 6061 aluminum alloy extrusion, the method comprising:

(a) providing an aluminum alloy billet comprised of aluminum alloy 6061;

(b) homogenizing the billet;

(c) cooling the billet;

(d) reheating the billet;

(e) extruding the billet above 900° F. to form an extrusion;

(f) first stage cooling the extrusion to about 500° F. at a first stage cooling rate from about 25° F. per second to about 80° F. per second, wherein the first stage cooling rate is below a critical cooling rate such that the extrusion is essentially free of thermal stress distortion;

(g) second stage cooling the extrusion to ambient temperature;

(h) heating the extrusion to an artificial aging temperature ranging from about 350° F. to about 400° F. in less than about eight hours after the second stage cooling; and (i) artificially aging the extrusion at the artificial aging temperature for about 5 to about 120 minutes to form the heat treated 6061 aluminum alloy extrusion in a peak strength temper.

18. The method of claim 17, wherein the heating of the extrusion to the artificial aging temperature of about 340° F. to about 400° F. is within about 15 minutes or less after the second stage cooling.

19. The method of claim 17, wherein the heating of the extrusion to the artificial aging temperature of about 340° F. to about 400° F. within about 4 hours after the second stage cooling.

* * * * *